US006550197B1

(12) United States Patent
Gray

(10) Patent No.: US 6,550,197 B1
(45) Date of Patent: Apr. 22, 2003

(54) METHODS AND APPARATUS FOR A MULTI-STORY DWELLING WITH ATTACHED GARAGES

(76) Inventor: Bruce W. Gray, 6001 N. 51st Pl., Paradise Valley, AZ (US) 85253

( * ) Notice: Subject to any disclaimer, the term of this patent is extended or adjusted under 35 U.S.C. 154(b) by 0 days.

(21) Appl. No.: 09/721,258

(22) Filed: Nov. 22, 2000

Related U.S. Application Data

(60) Provisional application No. 60/167,107, filed on Nov. 23, 1999, and provisional application No. 60/166,785, filed on Nov. 22, 1999.

(51) Int. Cl.[7] ..... E04H 1/04

(52) U.S. Cl. ..... 52/236.3; 52/185; 52/186; 52/236.4

(58) Field of Search ..... 52/185, 184, 186, 52/191, 234, 236.3, 236.4, 174

(56) References Cited

U.S. PATENT DOCUMENTS

| | | | | |
|---|---|---|---|---|
| 1,692,508 A | * | 11/1928 | Mcavoy | 52/236.3 |
| 3,656,266 A | * | 4/1972 | Tylius | 52/30 |
| 3,830,026 A | * | 8/1974 | Tylius | 52/185 |
| 4,098,039 A | | 7/1978 | Sutelan | |
| 4,596,097 A | * | 6/1986 | Stewart et al. | 52/185 |
| 4,794,747 A | * | 1/1989 | Yendo | 52/236.3 |
| 5,694,725 A | | 12/1997 | Kaufman et al. | |
| 5,749,186 A | * | 5/1998 | Kaufman et al. | 52/236.3 |
| 5,941,034 A | * | 8/1999 | Frankfurt | 52/236.3 |

FOREIGN PATENT DOCUMENTS

| | | | | |
|---|---|---|---|---|
| FR | 2550264 | * | 2/1985 | 52/236.3 |
| GB | 2264726 | * | 2/1992 | 52/236.3 |
| JP | 06294222 | * | 10/1994 | 52/236.3 |
| JP | 06322833 | * | 11/1994 | 52/236.3 |

OTHER PUBLICATIONS

Steinberg Collaborative AIA, LLP, Architects and Planners, 1993, pp. 2–4.*
Building Plans for Single–Car Garage Complex as Submitted for Permit.
Advertisement for Single–Car Garage Complex.

* cited by examiner

*Primary Examiner*—James O. Hansen
*Assistant Examiner*—Phi Dieu Tran A
(74) *Attorney, Agent, or Firm*—Snell & Wilmer LLP

(57) ABSTRACT

A high-efficiency residential structure includes a set of dwelling units, wherein a portion of the dwelling units are first-floor dwelling units and a portion of said dwelling units are second-floor dwelling units, a set of garages comprising a plurality of parking spaces, wherein the dwelling units and the garages are disposed within a footprint associated with the residential structure, a set of interior passageways, each of the interior passageways directly linking one of the dwelling units to one of the garages such that the site-density, yield, direct-access ratio, and efficiency of the structure is substantially optimized

6 Claims, 6 Drawing Sheets

METHODS AND APPARATUS FOR A MULTI-STORY DWELLING WITH ATTACHED GARAGES

CROSS-REFERENCE TO RELATED APPLICATIONS

This application claims priority from U.S. Provisional Application Serial No. 60/166,785, filed Nov. 22, 1999, and U.S. Provisional Application Serial No. 60/167,107, filed Nov. 23, 1999, both of which are hereby incorporated by reference.

BACKGROUND OF THE INVENTION

1. Technical Field

The present invention relates, generally, to dwelling structures and, more particularly, multi-story dwellings (e.g., apartment buildings and the like) incorporating a cost effective, efficient, and high unit-density attached garage configuration.

2. Background Information

The price of vacant land in dense, urbanized areas has increased dramatically in recent years. As a result, the cost of developing land in central core areas has proven to be a significant barrier to entry for most developers, particularly where multi-family residential developments are concerned.

In order to overcome the high cost of land in such areas, virtually all projects built in major metropolitan areas during this decade have resorted to various undesirable and expensive methods. Such methods include, for example, high-density housing projects developed with government sponsorship or subsidies, and/or high-density housing projects employing a combination of small dwelling units with a centralized parking structure unconnected to the dwelling units. The latter solution is substantially more expensive and generally results in a less desirable, and therefore less marketable, end product.

While residential structures with integral, private garages are known, such structures are undesirable in a number of respects. For example, such systems require more buildings and/or a larger building footprints to achieve the same number of units, yielding a lower overall site density, and increasing the cost of land and other fixed development costs on a per unit basis.

Furthermore, known structures yield a smaller average unit size and/or fewer two and three-bedroom units (i.e., more studio and/or one-bedroom units), with less rentable building square footage per acre of land.

In addition, known structures tend to sacrifice dwelling-access from private garages to many or all of the units. That is, these buildings use remote exterior access and/or common corridors to access individual units. Such designs require larger sites (e.g., on the order of five acres or more) to accomplish the same construction and/or operating economies. Such structures may also include a large number of stories, increasing its height, and requiring an elevator and/or expensive non-combustible construction.

Methods are therefore needed in order to overcome these and other limitations of the prior art. Specifically, there is a long-felt need for a marketable, cost-effective, attached-garage, multi-family architectural design with the highest possible yield using the most compact building footprint. Furthermore, it is desirable to create a more attractive, highly marketable, and costeffective product design which is financially feasible on small and/or irregular parcels of land.

SUMMARY OF THE INVENTION

In accordance with the present invention, a high-efficiency residential structure includes a set of dwelling units, wherein a portion of said dwelling units are first-floor dwelling units and a portion of said dwelling units are second-floor dwelling units; a set of garages comprising a plurality of parking spaces, wherein said dwelling units and said garages are disposed within a footprint associated with said residential structure; a set of interior passageways, each of said interior passageways directly linking one of said dwelling units to one of said garages such that the site-density, yield, direct-access ratio, and efficiency of the structure is substantially optimized.

In accordance with one embodiment of the present invention, a multi-story structure includes fourteen dwelling units per building, with eleven attached single-car garages and two attached two-car garages.

Accordingly, structures in accordance with various aspects of the present invention provide for: 1) higher overall site densities, reducing the cost of land and other fixed development operating costs on a per-unit basis; 2) enhanced resident convenience, safety, and security; 3) higher net livable building square-footage per acre of land; 4) increased unit-mix with more two and three-bedroom units; 5) uncommonly compact building footprint offering excellent site design flexibility, creating an opportunity to develop small, irregular and/or otherwise undevelopable parcels of land; 6) lower construction costs than projects with a centralized concrete parking structure and/or projects requiring elevators or non-combustible construction; 7) enhanced compatibility with adjacent single-family neighborhoods, hence greater political and municipal agency acceptance for land use and zoning purposes; 8) potentially higher long-term property values; and 9) excellent condominium-conversion potential.

BRIEF DESCRIPTION OF THE SEVERAL VIEWS OF THE DRAWINGS

The subject invention will hereinafter be described in conjunction with the appended drawing figures, wherein like numerals denote like elements, and.

DETAILED DESCRIPTION OF PREFERRED EXEMPLARY EMBODIMENTS

Figure 1:
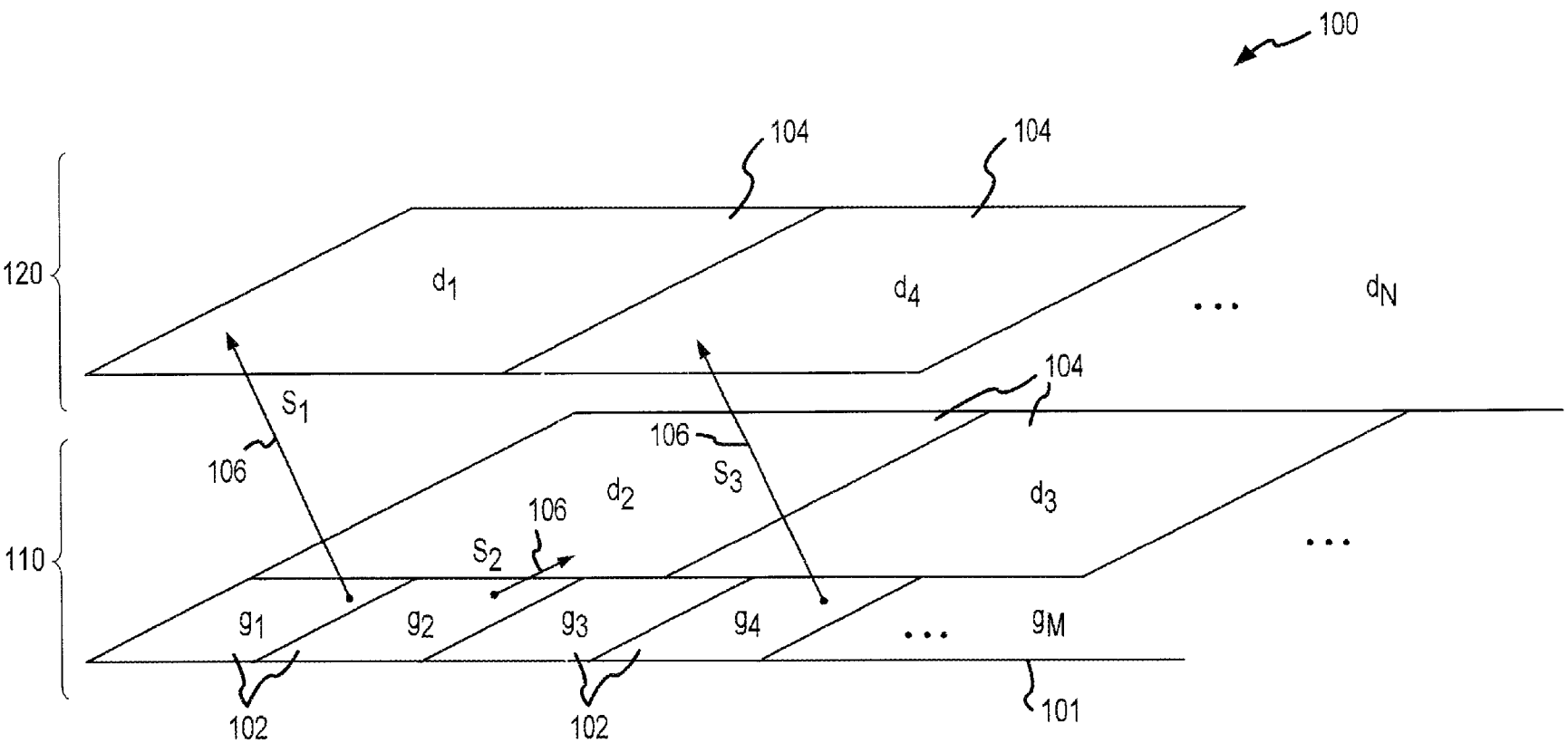
FIG. 1 is a conceptual isometric overview of a structure in accordance with the present invention showing exemplary nomenclature for characterizing the connectivity of garages and dwelling units.

In accordance with various aspects of the present invention, a high-efficiency residential structure includes a set of dwelling units, wherein a portion of said dwelling units are first-floor dwelling units and a portion of said dwelling units are second-floor dwelling units; a set of garages comprising a plurality of parking spaces, wherein said dwelling units and said garages are disposed within a footprint associated with said residential structure; and a set of interior passageways, each of said interior passageways directly linking one of said dwelling units to one of said garages such that the site-density, yield, direct-access ratio, and efficiency of the structure is substantially optimized.

As a preliminary matter, the present invention may be described with reference to various building materials, architectural drawings, site plans, and the like. The various conventions and a symbols shown in the drawing, and the details shown therein, will be readily understood by those skilled in the art. It will also be understood that the present invention may be practiced using a variety of materials, in any number of building contexts, and in connection with a variety of building sites. The structures described herein are merely example embodiments of the present invention.

Overview and Nomenclature

Referring now to FIG. 1, a multi-story dwelling 100 in accordance with various aspects of the present invention generally includes a plurality of dwelling units 104, a portion of which are linked to respective garages 102 via interior passageways 106. More particularly, introducing a nomenclature used throughout this Description, multi-story dwelling 100 includes a set G of L garages 102, designated as:

$$G=\{g_1,g_2,g_3, \ldots ,g_L\};$$

and a set D of N dwelling units 104, designated as:

$$D=\{d_1,d_2,d_3, \ldots ,d_N\};$$

wherein one or more of the dwelling units in the set D are linked to a respective garage in the set G via an interior passageway 106.

Each of the garages 102 may include a single parking space (single-car garage) or multiple parking spaces (two-car garage, three-car garage, etc.). Moreover, the garages and parking spaces may have any suitable geometry and dimensions, and it is not necessary that each of the garages and spaces be of equal size. Thus, while the structure itself comprises L total garages, it may include more than L parking spaces. For clarity purposes, $L_{park}$ is used to designate the total number of parking spaces.

The set of M interior passageways 106 is designated as S, such that:

$$S=\{s_1,s_2,s_3, \ldots ,S_M\}$$

Passageways 106 may include any convenient structural feature or features intended to allow an individual to pass from a garage 102 to a dwelling unit 104. In the case of a first floor dwelling unit, for example, a passageway 106 might include a door, doorway, and/or a hallway. In the case of a second floor dwelling unit, passageway 106 might include a stairway, a door, doorway, and/or a hallway. In the illustrated embodiment described below, individual passageways lead directly from the garage to the dwelling unit, with no intervening garages, public hallways, or external pathways. The nature of individual doors and stairways are known to those skilled in the art, and will not be detail herein. Nevertheless, the particular arrangement and orientation of passageways contemplated by the present invention will be discussed further below.

With continued reference to FIG. 1, the number of garages (L) is not necessarily equal to the number of dwelling units (N), and not every garage $g_i$ is necessarily linked to a corresponding dwelling unit $d_1$. Thus, the number of interior passageways is, in this model, less than or equal to the total number of dwelling units ($M \leqq N$).

Considering for example the structure illustrated conceptually in FIG. 1, the set of dwelling units D comprises the elements d, through $d_4$(N=4), and the set of garages G comprises the elements $g_1$ through $g_4$(L=4). Three of the dwelling units are connected to respective garages, while one is not (M=3), hence:

$s_1$ links $d_1$ and $g_1$;

$s_2$ links $d_2$ and $g_2$;

$s_3$ links $d_4$ and $g_4$; and $d_3$ and $g_3$ are not linked.

In order to more compactly describe the passageway topology, we can describe the set S as a set of unordered pairs selected from sets D and G, such that (in accordance with the above example):

$$S=\{<d_1,g_1>,<d_2,g_2>,<d_4,g_4>\}$$

The illustrated embodiment includes a first floor 110 and a second floor 120, wherein the first floor perimeter substantially defines a footprint 101. A portion of dwelling units D are located on first floor 110, and a portion are located on second floor 120. The subset of dwelling units on the first floor is designated $D_1F$, and the subset of dwelling units on the second floor is designated $D_{2F}$, such that the combination (union) of the two subsets is equivalent to the set of all dwelling units, i.e., $D=D_{1F}\cup D_{2F}$. Likewise, the set of passageways S can be partitioned into passageways associated with first-floor dwellings ($S_{1F}$) and passageways associated with second-floor dwellings ($S_{2F}$).

In summary, then, the topology of the example shown in FIG. 1 can be characterized fully by the following statements: (1) $D=D_{1F}\cup D_{2F}=\{d_2, d_3\}\cup\{d_1, d_4\}$ (two dwelling units on the first floor, two on the second floor); (2) $G=\{g_1, g_2, g_3, g_4\}$ (four garages); and (3) $S=S_{1F}\ominus\cup S_{2F}=\{<d_2, g_2>\}\cup\{<d_1, g_1>, <d_4, g_4>\}$ (one interior passageway linked to the dwelling unit on the first floor, two linked to dwelling units on the second floor).

Example Embodiment

Figure 2:
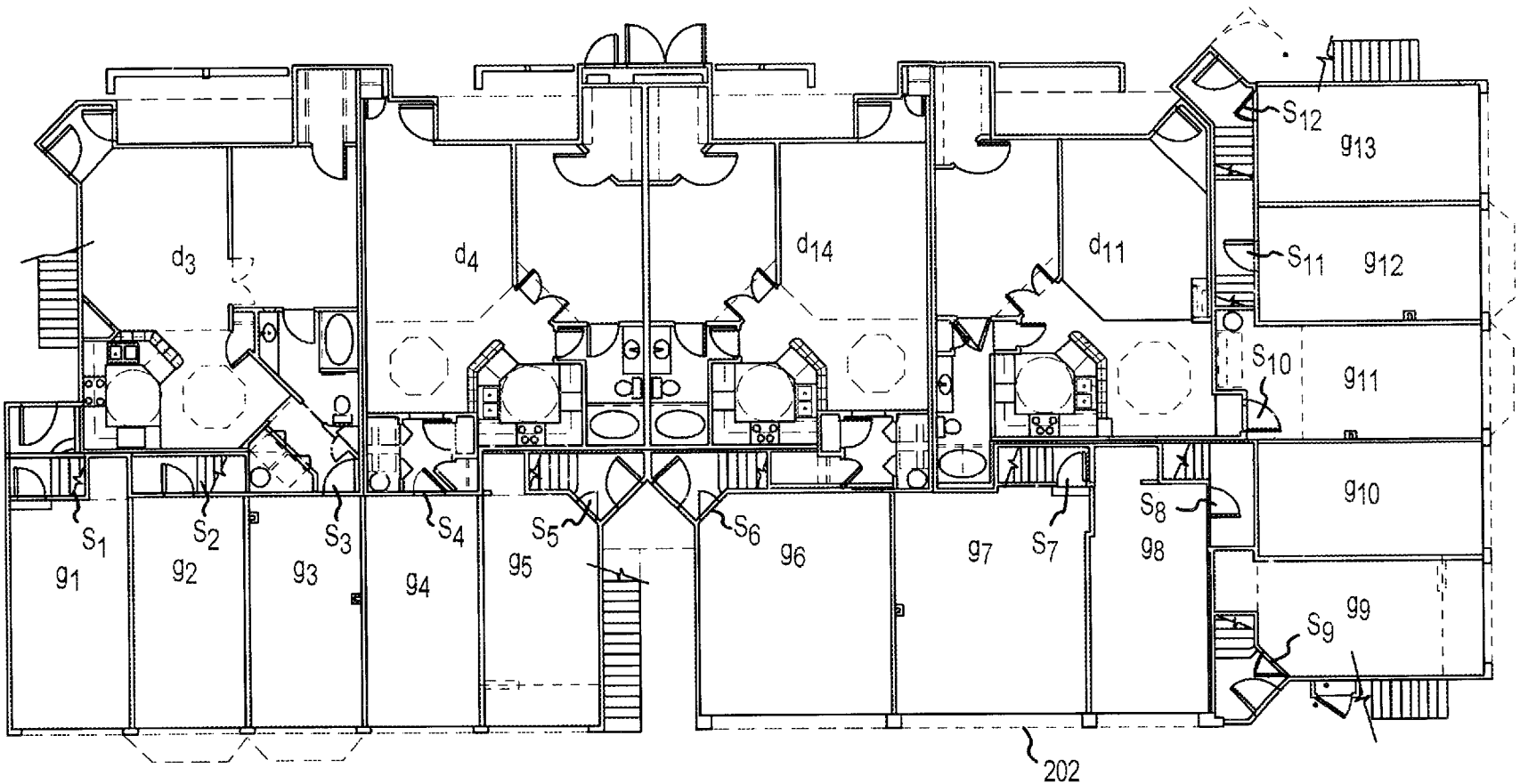
FIG. 2 shows a first floor and garage plan for a structure in accordance with one embodiment of present invention.
Figure 3:
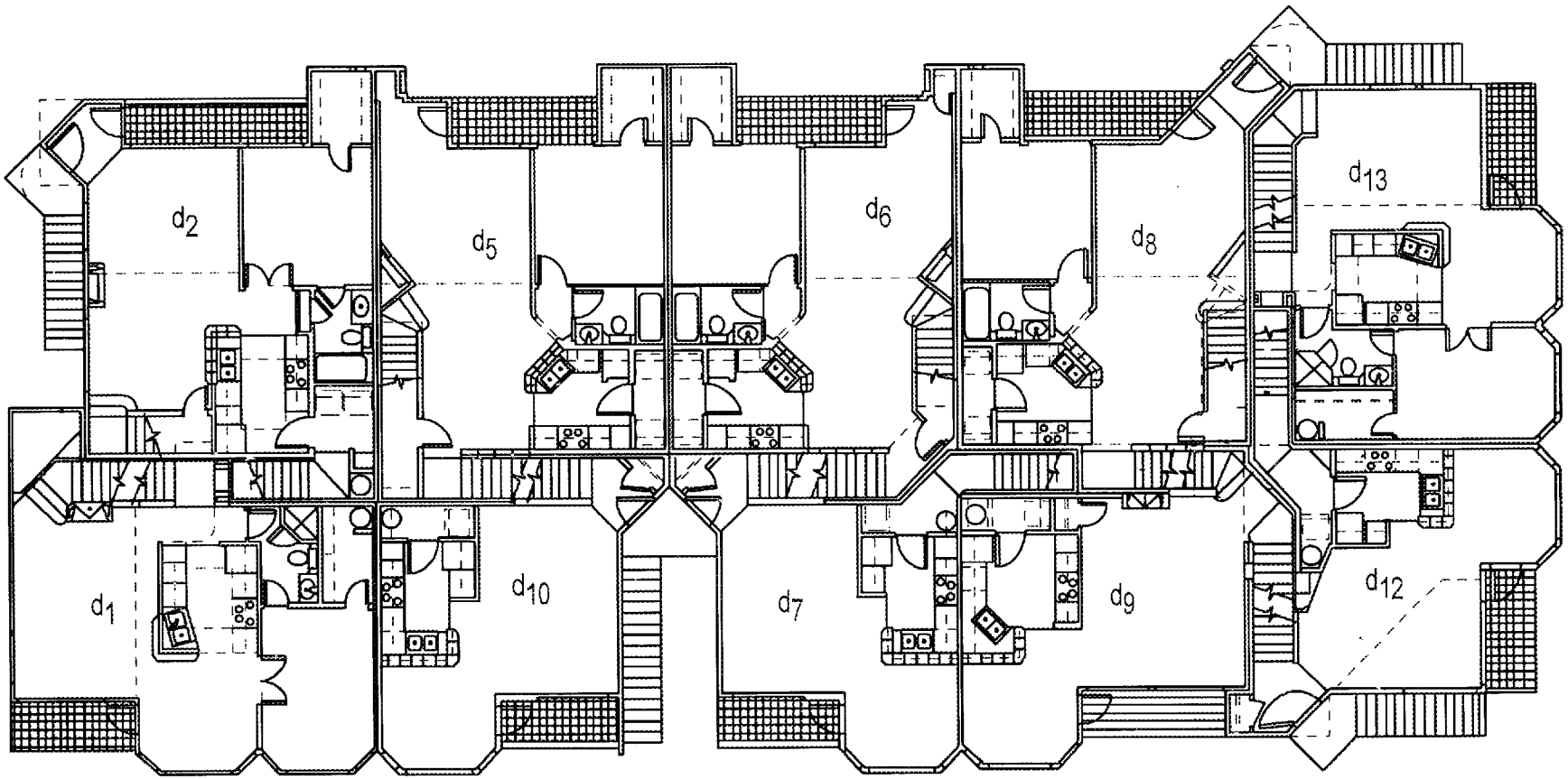
FIG. 3 shows a second floor plan in accordance with one embodiment of the present invention.
Figure 4:
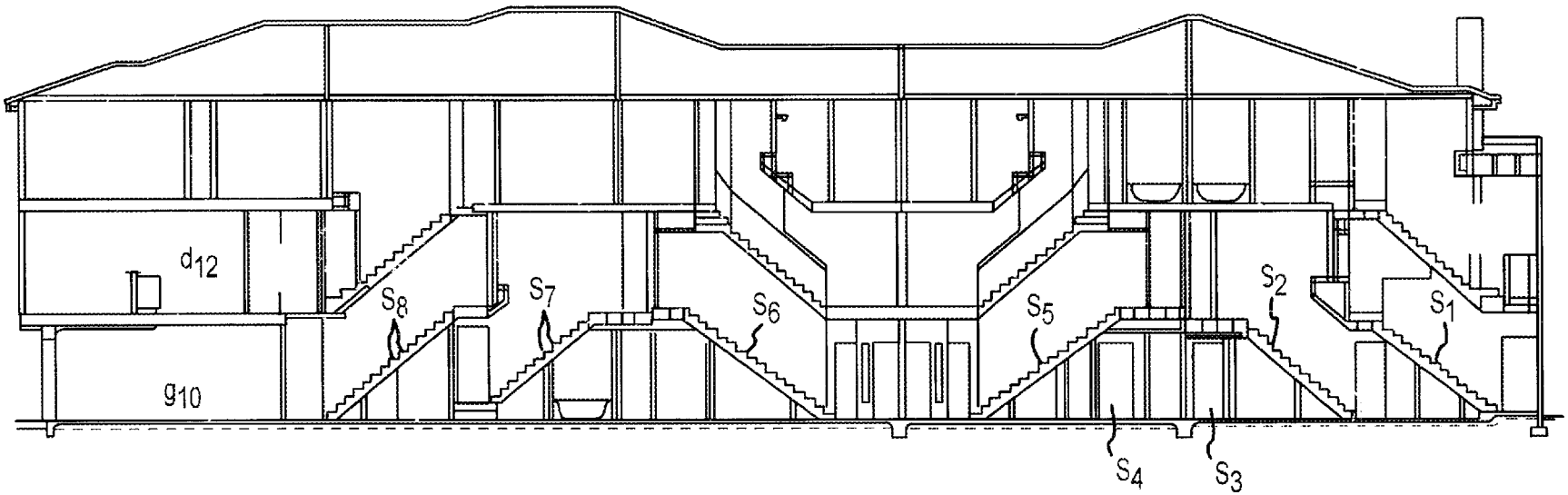
FIG. 4 shows a longitudinal stair section in accordance with one embodiment of the present invention.
Figure 5:
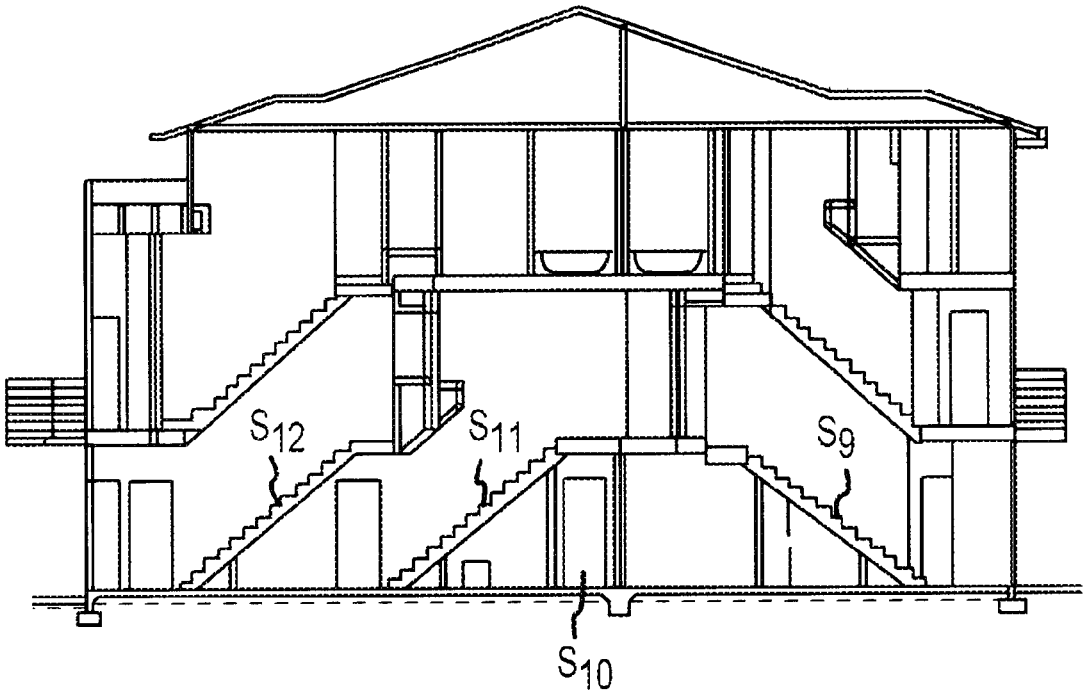
FIG. 5 shows a lateral stair section in accordance with one embodiment of the present invention.
Figure 6:
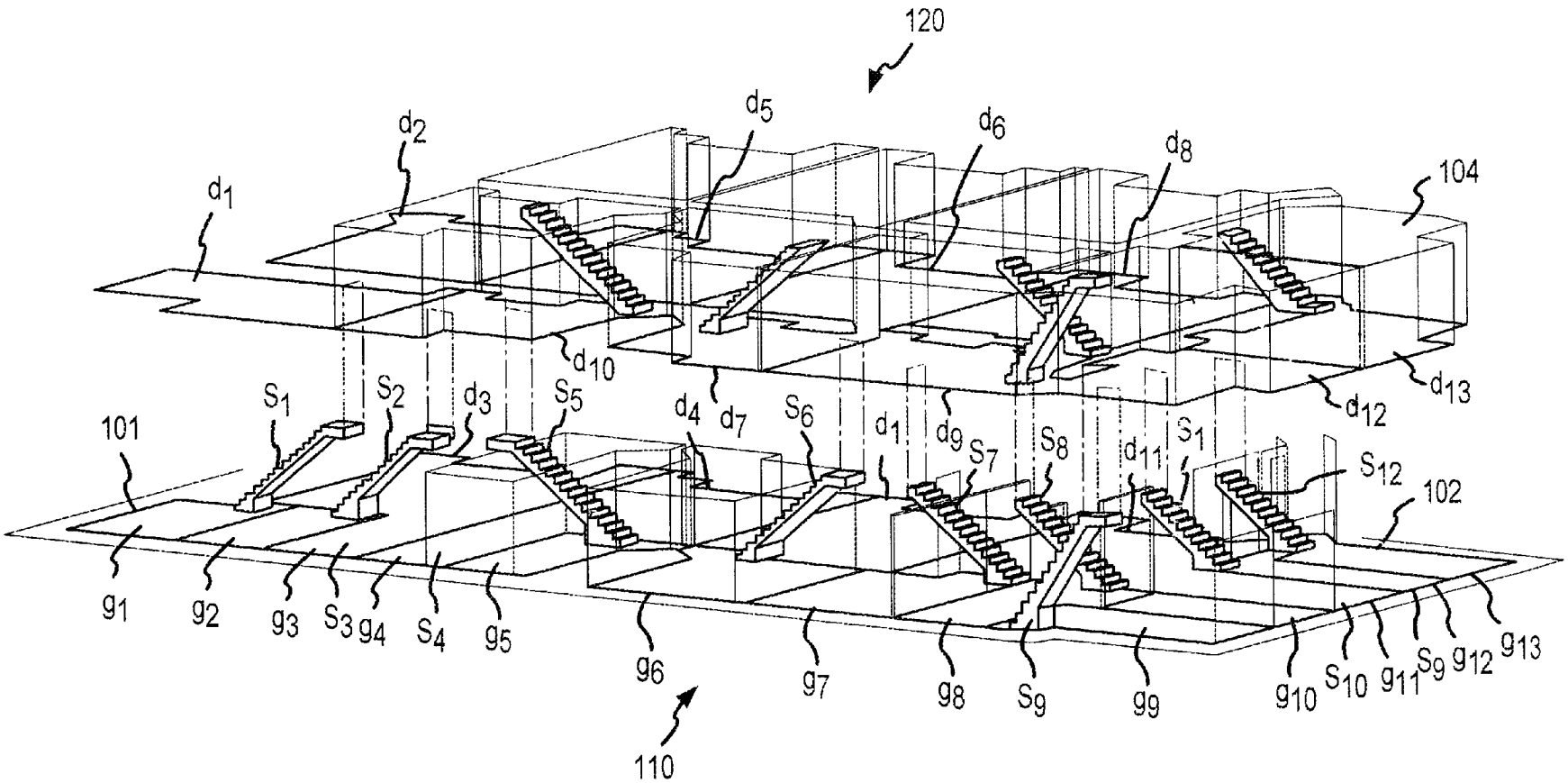
FIG. 6 shows an isometric partial view of a structure in accordance with one embodiment of the present invention.

FIGS. 2–6 depict various views of a structure in accordance with one embodiment of the present invention. FIG. 2 shows a first floor and garage plan for the illustrated embodiment, and FIG. 3 the corresponding second floor plan. FIG. 4 shows a longitudinal stair section of the illustrated embodiment through passageways $s_8$, $s_7$, $s_6$, $s_5$, $s_2$, and $s_1$. Similarly, FIG. 5 shows a lateral stair section of the illustrated embodiment through passageways $s_{12}$, $s_{11}$, and $s_9$. FIG. 6 shows a isometric cut-away view of the first and second floors of the illustrated embodiment, with many of the details removed.

In the interest of clarity, the designations set forth above for the various rooms and garages (i.e., di, $g_1$, etc.) will be used to refer to particular elements of the structure. Furthermore, although the illustrated embodiment includes a total of three levels, only the configuration of the first two stories will be discussed in detail.

In general, referring now to FIG. 6, first floor 110 comprises thirteen garages 102 and four dwelling units 104, wherein three of the four dwelling units are directly linked to respective garages. Two of the garages are nominally the size of a standard two-car garage ($g_6$ and $g_7$), and the remaining garages are nominally the size of a single-car garage. The number of parking spaces, $L_{park}$, is equal to fifteen.

The second floor 120 comprises ten dwelling units, nine of which are directly linked to respective garages via interior passageways (e.g., stairways, as shown). Thus, the illustrated embodiment includes a total of fourteen dwelling units and thirteen garages, where twelve of the garages are directly linked to respective dwelling units. Using the nomenclature outlined above, the illustrated embodiment will now be formally defined.

The set of thirteen garages (L=13) includes $g_1$ through $g_{13}$, and the set of fourteen dwelling units (N=14) includes $d_1$ through $d_{14}$. The first floor and second floor dwelling units can then be defined as:

$$D_{1F}=\{d_3,d_4,d_{11},d_{14}\}; \text{ and}$$

$$D_{2F}=\{d_1,d_2,d_5,d_6,d_7,d_8,d_9,d_{10},d_{12},d_{13}\}$$

As noted above, twelve dwelling units are directly linked to garages via interior passageways. Thus, M=12, and the set of first floor and second floor passageways are defined as:

$$S_{1F}=\{<g3,d3>,<g4,d4>,<g11,d11>\}; \text{ and}$$

$$S_{2F}\{<g1,d1>,<g2,d2>,<g5,d5>,<g6,d6>,<g7,d7>,<g8,d8>,<g9,d9>,<g12, d12>,<g13,d13>\}$$

As illustrated, the ratio of units with directly linked garages to total units (M/N) is 6/7, and the ratio of second floor units with directly linked garages to total units is 9/14. Note also that the ratio of $L_{park}/N$ is greater than one (i.e., 15/14).

Referring now to the plan view of the exemplary first floor and garage design shown in FIG. 2, the thirteen garages $g_1$–$g_{13}$ are, in general, configured in an "L" shape. The "L" shape configuration (eight garages, totaling ten spaces, on one side, and five garages on one end) provides a linkage of twelve of thirteen garages directly to the main living area of its assigned unit by way of a novel system of interior passageways and nested (i.e., stacked), private interior stairways. That is, garages g1–g8 lie along one side of the structure (with the respective garage openings or doors 202 facing the same direction), and garages g9–g13 continue along an adjacent side of the structure along a line which is substantially perpendicular to that defined by garages g1–g8.

In the illustrated embodiment, the corner of the "L" configuration includes a nested trio of passageways $s_7$, $s_8$, and $s_9$, connected to garages $g_7$, $g_8$, and $g_9$ respectively. Passageways $s_7$ and $s_8$ lie substantially in the same plane and are substantially parallel, while $s_9$ is oriented orthogonal to $s_8$.

In accordance with the illustrated embodiment, second-floor dwelling units $d_2$, $d_5$, $d_6$, and $d_8$ are configured such that $d_2$ is adjacent to $d_5$, $d_5$ is adjacent to $d_6$, and $d_6$ is adjacent to $d_8$. Similarly, first floor dwelling units $d_3$, $d_4$, $d_{14}$, and $d_{11}$ are configured such that $d_3$ is adjacent to $d_4$, $d_4$ is adjacent to $d_{14}$, and $d_{14}$ is adjacent to $d_{11}$. Furthermore, dwelling units $d_2$, $d_5$, $d_6$ are arranged such that $d_2$ lies substantially above $d_3$, $d_5$ lies substantially above $d_4$, $d_6$ lies substantially above $d_{14}$, and $d_8$ lies substantially above $d_{11}$. Dwelling $d_{12}$ is adjacent to $d_{13}$, both of which are located substantially above the five garages which make up the shorter side of the "L" configuration, i.e., $g_9$, $g_{10}$, $g_{11}$, $g_{12}$, and $g_{13}$.

The present invention provides structures with an extremely compact and efficient building-footprint and form, offering improved site design and land planning flexibility, higher overall yield (i.e., more rentable area), and optimal land utilization. footprint 59" by 131" 133×62 total (+bay windows, etc.). For example, in accordance with the illustrated embodiment, multiple structures may be built on a single site such that the overall dwelling unit density is above about 30 units per acre. In a preferred embodiment, for example, the dwelling unit density ranges from about 35 to 45 units per acre.

In accordance with one embodiment of the invention, a multi-story structure is constructed using conventional wood-frame construction with partial masonry shear walls, depending upon actual building configuration, geometry, and fenestration. As noted above, however, the present invention may be employed using a variety of building materials and methods.

Although the invention has been described herein in conjunction with the appended drawings, those skilled in the art will appreciate that the scope. of the invention is not so limited. For example, buildings with fewer or more units—and/or fewer or more garages—may be designed in accordance with the present invention. Modifications in the selection, design, and arrangement of the various components and steps discussed herein may be made without departing from the scope of the invention as recited in the appended claims.

What is claimed is:

1. A residential structure, said residential structure comprising:

a set of N dwelling units, wherein a portion of said dwelling units are first-floor dwelling units and a portion of said dwelling units are second-floor dwellng units;

a set of L garages G comprising $L_{park}$ parking spaces, wherein said dwelling units and said garages are disposed within a footprint associated with said residential structure;

A set of M interior passageways, each of said interior passageways directly linking one of said dwelling units to one of said garages, wherein the ratio M/N is greater than or equal to 6/7, and the ratio $L_{park}/N$ is greater than one; wherein:

L=13, wherein said set of garages G includes $g_1$ through $g_{13}$;

N=14, wherein said set of dwelling units D includes $d_1$ through $d_{14}$;

said first-floor dwelling units include $D_{1F}=\{d_3, d_4, d_{11}, d_{14}\}$;

said second-floor dwelling units include $D_{2F}=\{d_1, d_2, d_5, d_6, d_7, d_8, d_9, d_{10}, d_{12}, d_{13}\}$;

M=12, and said set of interior passageways include:

a set of first floor passageways $S_{1F}=\{<g3,d3>,<g4,d4>,<g11,d11>\}$; and a set of second floor passageways $S_{2F}=\{<g1,d1>,<g2,d2>,<g5,d5>,<g6,d6>,<g7,d7>,<g8,d8>,<g9,d9>,<g12,d12>,<g13, d13>\}$.

2. The structure of claim 1 wherein said dwelling units comprise wood-frame structures.

3. The structure of claim 1, wherein said dwelling units comprise masonry shear walls.

4. The structure of claim 1, wherein at least one of said interior passageways is an internal stairway.

5. The structure of claim 1, wherein said structure has a dwelling unit density wherein above approximately 30 units per acre.

6. The structure of claim 5, wherein said dwelling unit density ranges from about 35 to 45 units per acre.

* * * * *